US008128259B2

(12) United States Patent
Myers et al.

(10) Patent No.: US 8,128,259 B2
(45) **Date of Patent: *Mar. 6, 2012**

(54) SPHERICAL ORNAMENTAL FIXTURE

(75) Inventors: Cyrus Myers, Plattsburgh, NY (US); Timothy Patnode, Peru, NY (US)

(73) Assignee: Schonbek Worldwide Lighting Inc., Plattsburgh, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/950,307

(22) Filed: Nov. 19, 2010

(65) Prior Publication Data

US 2011/0063845 A1 Mar. 17, 2011

Related U.S. Application Data

(63) Continuation of application No. 11/624,373, filed on Jan. 18, 2007, now Pat. No. 7,854,532.

(51) Int. Cl.
*F21V 21/00* (2006.01)

(52) U.S. Cl. ..... 362/249.14; 362/249.01; 362/249.16; 362/382; 362/809

(58) Field of Classification Search ..... 362/249.01, 362/249.06, 249.14, 249.16, 382, 808–809; 428/7, 13

See application file for complete search history.

(56) References Cited

U.S. PATENT DOCUMENTS

| | | | |
|---|---|---|---|
| 5,144,541 | A | 9/1992 | Schonbek |
| 5,205,644 | A | 4/1993 | Bayer et al. |
| 5,645,343 | A | 7/1997 | Rinehimer |
| 5,906,430 | A | 5/1999 | Bayer |
| 6,070,991 | A | 6/2000 | Rumpel |
| 6,401,404 | B1 | 6/2002 | Fillipp et al. |
| 6,474,843 | B2 | 11/2002 | Shieh |
| D558,390 | S | 12/2007 | Myers |
| D560,019 | S | 1/2008 | Myers |
| D560,306 | S | 1/2008 | Ly |

OTHER PUBLICATIONS

Non-Final Office Action for U.S. Appl. No. 11/624,373, mailed Sep. 30, 2008.

Final Office Action for U.S. Appl. No. 11/624,373, mailed Mar. 25, 2009.

Non-Final Office Action for U.S. Appl. No. 11/624,373, mailed Sep. 29, 2009.

Final Office Action for U.S. Appl. No. 11/624,373, mailed May 3, 2010.

Schonbek Worldwide Lighting Inc. "All About Crystal" web page: http://www.schonbek.com/crystal/pages/cshapes.html.

*Primary Examiner* — Evan Dzierzynski
*Assistant Examiner* — Meghan Dunwiddie
(74) *Attorney, Agent, or Firm* — Heslin Rothenberg Farley & Mesiti P.C.

(57) ABSTRACT

An ornamental fixture having a support structure and a plurality of ornaments mounted to the support structure in a substantially completely spherical arrangement of ornaments. The ornaments may be glass crystal ornaments, for example, octagonal glass crystals, and a light may be mounted within the fixture. The support structure may include an upper support ring and at least one lower support ring vertically spaced from the upper support ring and a plurality of arcuate sector assemblies removably mounted to the upper support ring and the at least one lower support ring. The sector assemblies retain the ornaments to provide a substantially continuous 360-degree array of ornaments. The sector assemblies can also be disassembled from the support structure for maintenance, servicing, relamping, and cleaning of the fixture. For example, the disassembled components of the fixture may be washed in a dishwasher without damaging the ornaments or the support structure.

28 Claims, 10 Drawing Sheets

SPHERICAL ORNAMENTAL FIXTURE

CROSS REFERENCE TO RELATED APPLICATIONS

This patent application is a continuation application of U.S. application Ser. No. 11/624,373 filed on Jan. 18, 2007, now U.S. Pat. No. 7,854,532, the disclosure of which is included by reference herein in its entirety.

TECHNICAL FIELD

This invention relates, generally, to ornamental fixtures and methods for mounting ornaments in ornamental fixtures. More particularly, the invention relates to spherical ornamental fixtures that can be easily disassembled for servicing, relamping, maintenance, and washing, for example, in an automatic dishwasher.

BACKGROUND OF THE INVENTION

Imagine, a complete spherical crystal chandelier that encloses substantially the entire spherical surface with multifaceted ornamental crystals. Lighting fixture designers have long sought to obtain such a chandelier but were typically hampered by the limitations inherent in mounting ornamental crystals. For example, ornaments are typically mounted in the form of hanging chains of crystal ornaments, for example, as exemplified by the ornament chains disclosed in U.S. Pat. No. 5,144,541 of Arnold Schonbek. However, by abandoning the ornament chain mounting that characterizes the prior art, aspects of the present inventors provide the long sought after spherical ornamental fixture, such as chandelier.

In addition, ornamental light fixtures are notoriously difficult to clean. The intricacies of the mounting and handling of ornaments without damaging the ornaments or the mounting structure typically makes cleaning such fixtures a tedious and time consuming experience. According to the prior art, such fixtures are typically cleaned by hand, and never placed in a dishwasher. The agitation of a fixture by the vibration of the washer and impinging water jets can cause fragile, typically glass, crystals to strike each other and the support structure causing damage, for example, chipping or cracking. In addition, the support structures or chain mountings can also be susceptible to damage due to the harsh washing detergent, water, and elevated washing temperatures present in automated washers. Further still, the water of an automatic washer can be detrimental to any electrical lighting or wiring mounted in the fixture. According to conventional practice, automatic machine washing of ornamental fixtures is to be avoided.

Aspects of the present invention overcome these limitations of the prior art by providing an ornamental fixture, including ornamental glass crystals, that can be disassembled, relamped, and serviced, for example, washed in an automated washer, with no risk of damaging the ornaments or the ornament support structure.

SUMMARY OF THE INVENTION

In contrast to the shortcomings of the prior art, the present invention provides a completely spherical crystal chandelier. This spherical crystal chandelier can be disassembled for servicing, and the dissembled components can even be washed in an automated washer. Unlike prior art ornamental fixtures, aspects of the present invention provide support structures that retain ornaments, including glass crystal ornaments, in an arrangement that can be disassembled for servicing and maintenance. For example, one aspect of the invention is an ornamental fixture including a support frame assembly having an upper support ring and at least one lower support ring vertically spaced from the upper support ring; and a plurality of arcuate sector assemblies mounted to the upper support ring and the lower support ring, each sector assembly having a plurality of ornaments; wherein a substantially continuous 360-degree array of ornaments is provided. In one aspect, the plurality of sector assemblies may be removably mounted to the upper support ring and the lower support ring. In another aspect, the fixture comprises a substantially spherical ornamental fixture.

Another aspect of the invention is a method for assembling an ornamental fixture including providing a support frame assembly having an upper support ring and at least one lower support ring vertically spaced from the upper supper ring; and mounting a plurality of arcuate sector assemblies, each of the sector assemblies having a plurality of ornaments, to the upper support ring and to the lower support ring to provide a substantially continuous 360-degree array of ornaments. In one aspect, each of the plurality of sector assemblies includes an upper support plate and a lower support plate, wherein mounting the plurality of arcuate sector assemblies comprises mounting one upper support plate of at least one sector assembly to the upper support ring of the support frame assembly and mounting the lower support plate of at least one sector assembly to the at least one lower support ring of the support frame assembly.

One aspect of the invention includes a method of servicing an ornamental fixture wherein the above method is supplemented by removing at least one of the plurality of arcuate sector assemblies from the support frame assembly; and servicing, for example, cleaning, at least one of the plurality of arcuate sector assemblies without damaging the fixture and the ornaments. According to aspects of the invention, the components of the fixture may be cleaned in an automated washing device, for example, in a dishwasher.

A further aspect of the invention is a spherical ornamental fixture including a support structure; and a plurality of ornaments mounted to the support structure in a substantially completely spherical arrangement of ornaments, for example, a substantially completely uninterrupted spherical arrangement of ornaments. In one aspect, the plurality of ornaments may be glass crystal ornaments, for example, octagonal glass ornaments. In another aspect, a light source may be mounted within the spherical arrangement of ornaments.

These and other aspects, features, and advantages of the invention will become apparent from the following detailed description of the various aspects of the invention taken in conjunction with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION

Figure 1:
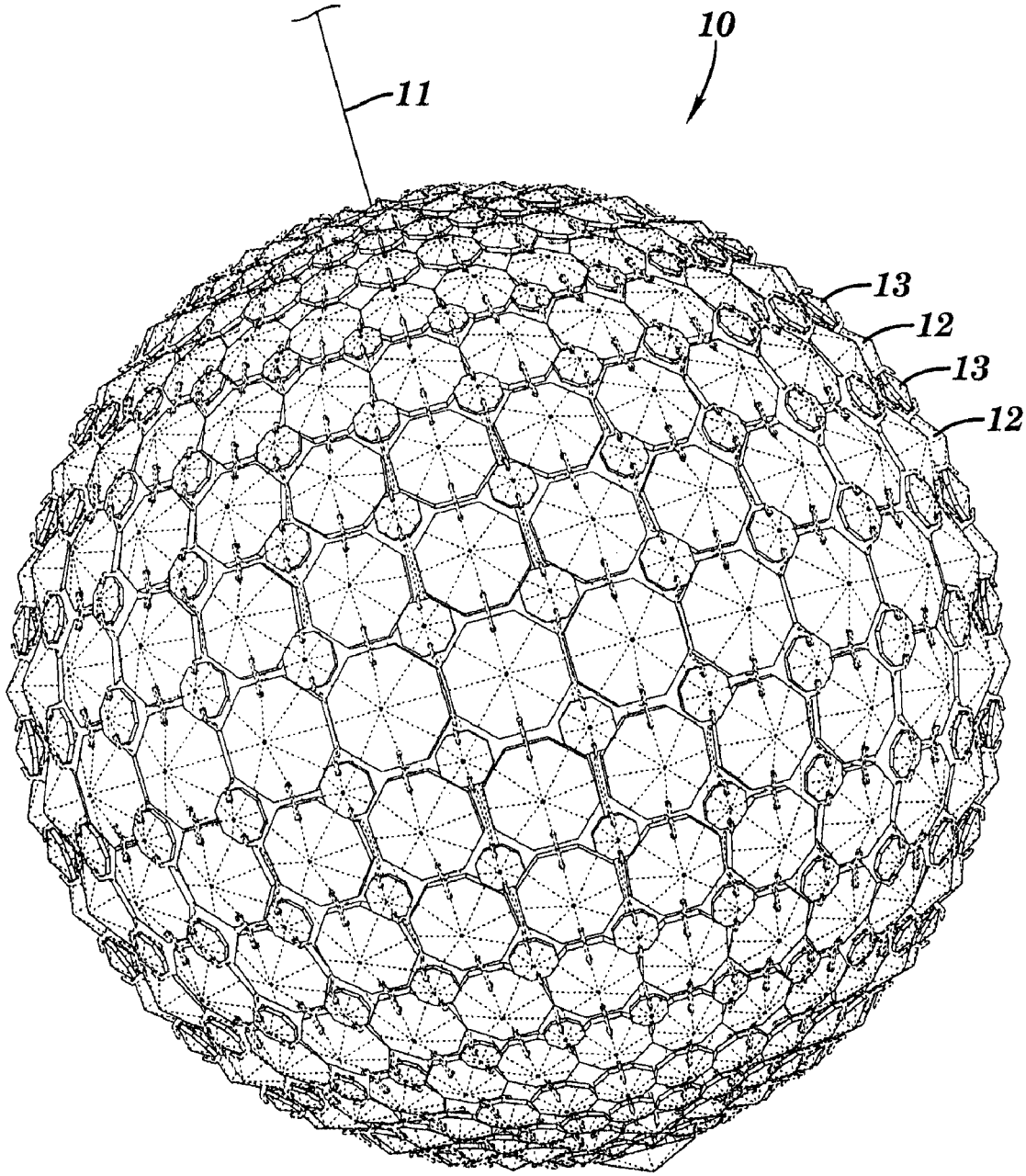
FIG. 1 is a perspective view of an ornamental fixture according to one aspect of the invention.

FIG. 1 is a perspective view of an ornamental fixture 10 according to one aspect of the invention. As shown in FIG. 1, one aspect of the invention comprises a spherical fixture 10 supported by cable 11 and having ornaments 12 and 13, for example, octagonal glass crystals, positioned on substantially the entire surface of a sphere. As will be discussed below, aspects of the invention need not be completely spherical in shape, but aspects preferably comprise at least a section having ornaments arranged in a substantially complete 360-degree array about the "equator" of the sphere. Fixture 10 shown in FIG. 1 is one fixture marketed under the trademark Da Vinci by Schonbek Worldwide Lighting Inc., the assignee of this application.

As will become apparent upon further review of aspects of the invention, some aspects of the invention comprise an easily dismantlable ornamental fixture 10, which can be disassembled for maintenance, servicing, relamping, and cleaning. In one aspect of the invention, most remarkably, fixture 10 is sufficiently robustly designed that the dismantled components of fixture 10 can be washed in an automated washing device, for example, in a conventional kitchen dishwasher, without damaging the ornaments 12 and 13 or the support structure of fixture 10.

Figure 2:
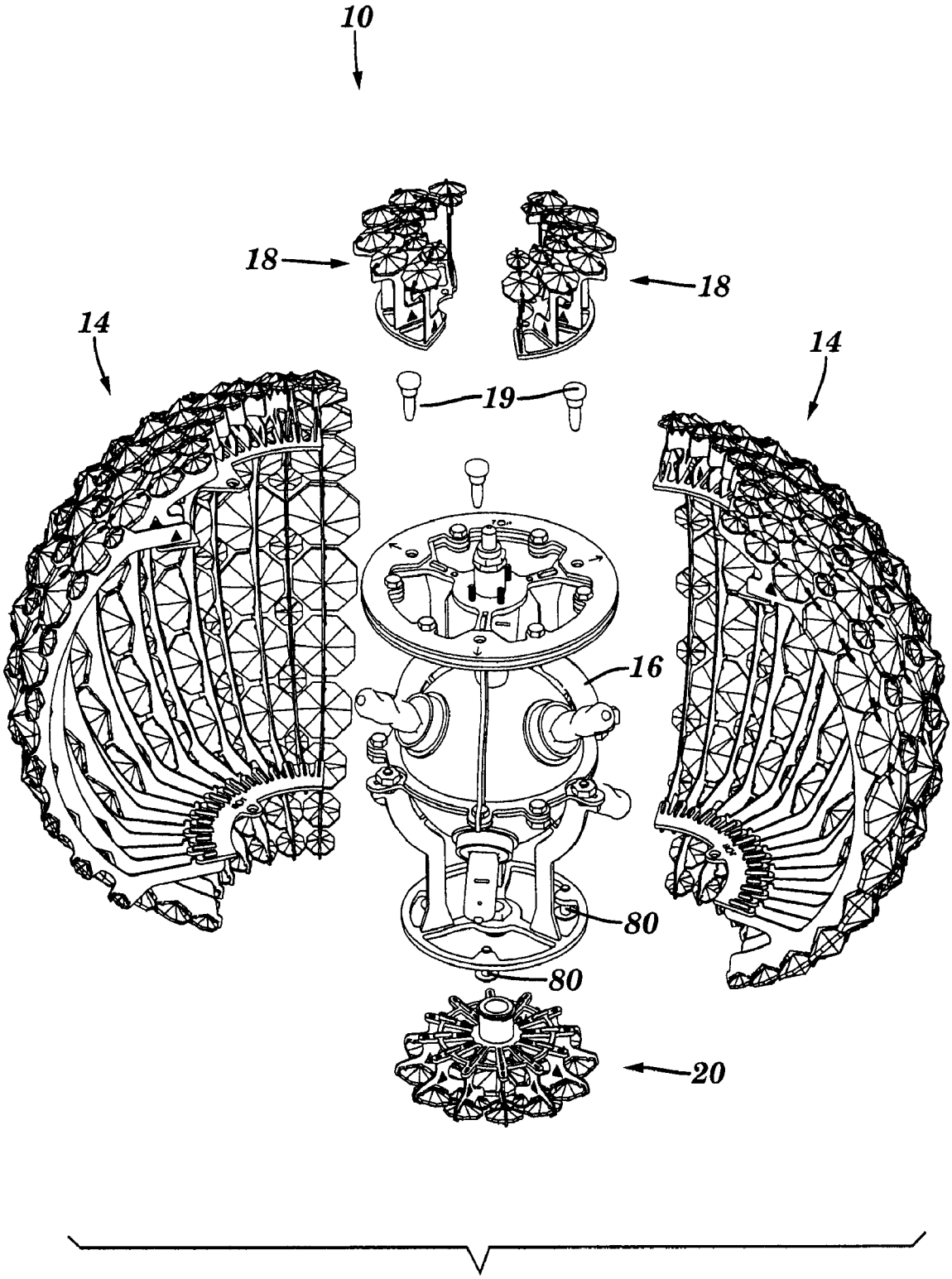
FIG. 2 is an exploded perspective view of the fixture shown in FIG. 1.

FIG. 2 is an exploded perspective view of fixture 10 shown in FIG. 1. As shown in FIG. 2, fixture 10 comprises a plurality of sector assemblies 14 adapted to mount to a central support frame assembly 16. Though the aspect of the invention shown in FIG. 1 includes three sector assemblies 14, only two sector assemblies 14 are illustrated in FIG. 2 to avoid obstructing features of the invention. Depending upon the size of fixture 10, two or more sector assemblies 14 may be provided, and may be mounted to support frame assembly 16 by conventional means, for example, conventional hardware. In one aspect, sector assemblies 14 may be mounted by means of screws or pins 19, as will be discussed below. Sector assemblies 14 are adorned with a plurality of ornaments 12 and 13, for example, glass crystals. Sector assemblies 14 may typically be substantially identical, for example, sector assemblies 14 may span equal longitudinal arcs (that is, east to west) and equal latitudinal arcs (that is, north to south), but sector assembles 14 may vary in one or both the longitudinal and/or the latitudinal arc length. Though in one aspect of the invention, sector assemblies 14 may span substantially 180 degrees of latitudinal arc, that is, run pole to pole, due to physical limitations of ornaments 12 and the availably of ornaments 12 of varying size, sector assemblies 14 may typically span less than 180 degrees of latitudinal arc, for example, span about 130 degrees or less of arc. In addition, in some aspects of the invention, sector assemblies 14 may comprise a plurality of sector assemblies spanning approximately 180 degrees in latitudinal arc length. For example, each sector assembly 14 may be provided by two sector assemblies of about 90 degrees in latitudinal arc length, three sector assemblies of about 60 degrees in latitudinal arc length, four sector assemblies of about 45 degrees or less in latitudinal arc length, or a combination thereof. As shown in FIG. 2, fixture 10 may typically include one or more sub assemblies, such as, one or more crown sector assemblies 18 and one or more finial sector assemblies 20 positioned in the "polar regions" of the fixture to complement sector assemblies 14 to provide the substantially complete spherical shape. As shown, crown sector assemblies 18 and finial sector assembly 20, that is, the polar support structures or sub-assemblies, are also mounted to support frame assembly 16. It will be understood that in some aspects of the invention, crown sector assemblies 18, finial sector assemblies 20, or both assemblies 18 and 20 may be omitted.

Figure 3:
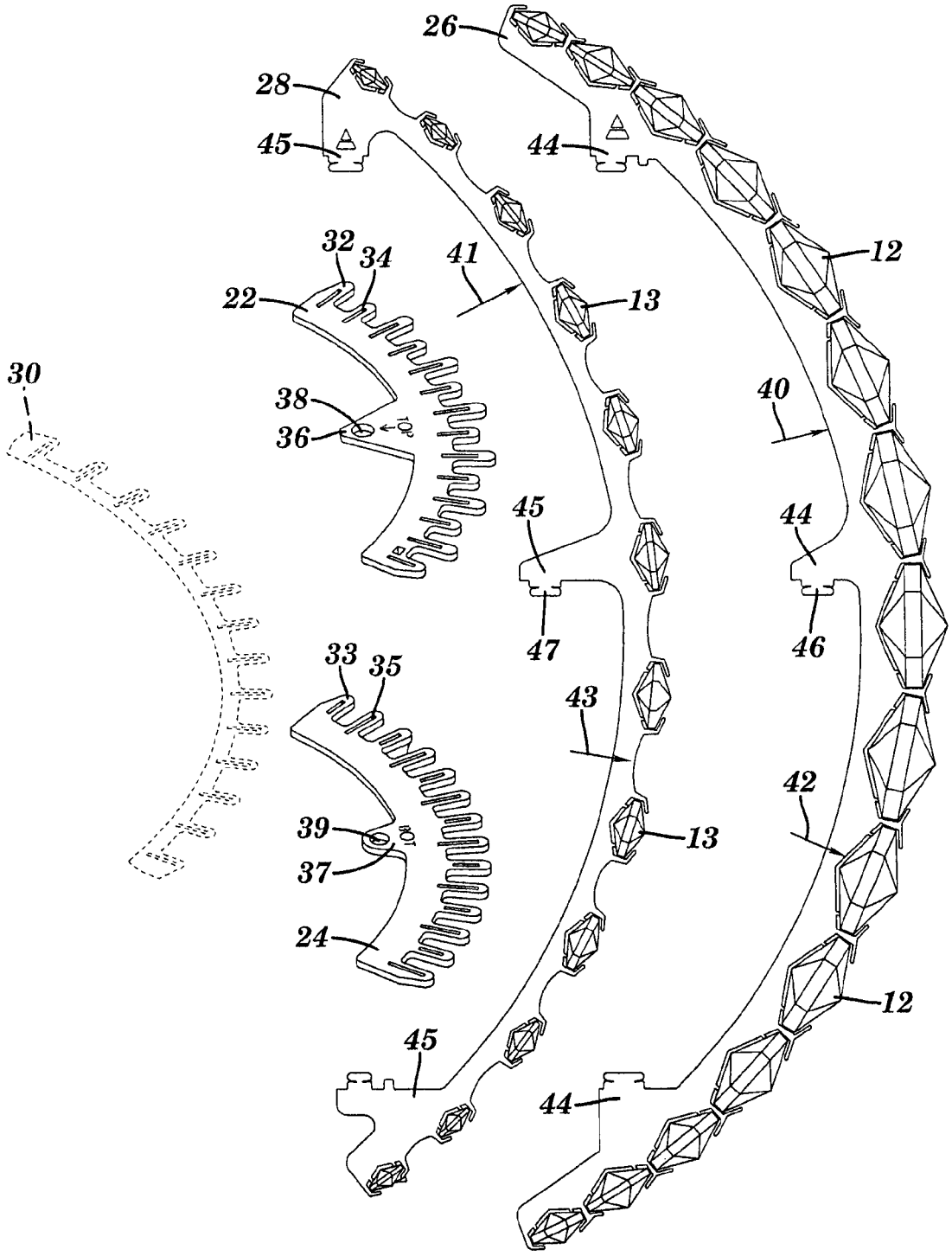
FIG. 3 is an exploded view of the components of a sector assembly shown in FIG. 2.

FIG. 3 is an exploded view of selected components of sector assembly 14 shown in FIG. 2. Sector assembly 14 includes at least an upper support plate 22, a lower support plate 24, and a plurality of ornament mounting ribs 26 and 28. For the sake of clarity of illustration and description, only one representative mounting rib 26 and 28 are shown in FIG. 3. It is understood according to the invention that fixture 10 may include a plurality of mounting ribs 26 and/or 28, for example, three or more, such as the eight mounting ribs 26 and the eight mounting ribs 28 shown in FIG. 2. Mounting ribs 26 and 28 may alternate around the periphery of fixture 10. Sector assembly 14 may include additional support plates similar to support plates 22 and 24, depending upon the size and structural requirements of the design. For example, in a larger design, at least one intermediate support plate 30, shown in phantom, may be positioned between support plates 22 and 24 and to which mounting ribs 26 and 28 may be mounted.

According to the invention, support plates 22 and 24 may typically comprise sectors of a thin ring, for example, 90-degree, 120-degree, or 180-degree sectors, depending upon the number and arc length of sector assemblies 14. As shown in FIG. 3, support plate 22 and 24 are typically adapted to support mounting ribs 26 and 28. For example, support plates 22 and 24 may include external radial projections 32 and 33, respectively, and radial slots 34 and 35, respectively, into which corresponding projections of ribs 26 and 28 are inserted and secured, though other conventional modes of securing ribs 26 and 28 to plates 22 and 24 may be provided. Support plate 22 and 24 are also typically adapted to be mounted to support frame assembly 16, for example, removably mounted to support frame assembly 16. For example, support plates 22 and 24 may include internal radial projections 36 and 37 having holes 38 and 39, respectively, to mount support plates 22 and 24 to support frame assembly 16, as will be discussed further below. Support plates 22 and 24 may vary in thickness from about 0.03125 inches to about 0.5 inches depending upon the size of fixture 10 and the weight of ornaments 12 and 13; however, plates 22 and 24 are typically between about 0.0625 and about 0.125 inches, such as, 0.0625 inches in thickness. Support plates 22 and 24 may also be made from plastic or metal, but are typically polished stainless steel, for example, polished 304 stainless steel. Support plates 22 and 24 may also be laser cut to provide the intricate geometry shown, though other conventional manufacturing methods may be used.

Figure 8:
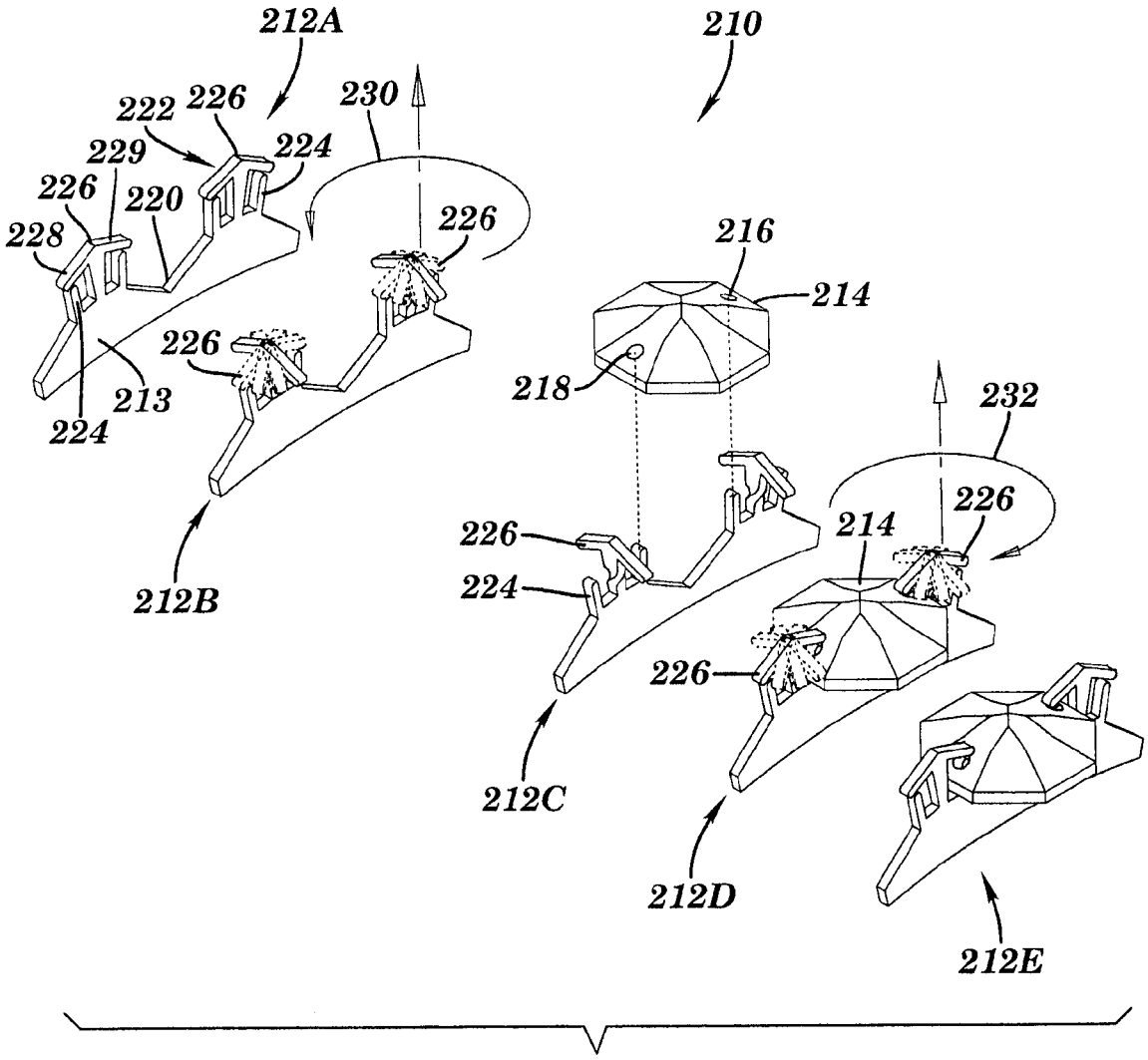
FIG. 8 is a perspective view illustrating a step-wise method of mounting ornaments according to one aspect of the invention.

Ornament mounting ribs 26 and 28 mount to support plates 22 and 24 and retain a plurality of ornaments 12 and 13, respectively. As shown in FIG. 3, mounting ribs 26 and 28 typically comprise thin arcuate sections having inside radii 40 and 41, respectively, and outside radii 42 and 43, respectively. Inside radii 40 and 41 may include projections 44 and 45, respectively, adapted to engage and be secured to support plates 22 and 24, for example, by means of tabs, 46 and 47, respectively. According to the present invention, outside radii 42 and 43, are adapted to receive ornaments 12 and 14, for example, octagonal crystals. Though ornaments 12 and 13 may be mounted to outside radii 42 and 43 by any conventional means, in one aspect, ornaments 12 and 13 may be mounted to mounting ribs 26 and 28 by means of one or more of the ornament mounting arrangement disclosed in U.S. Pat. No. 5,906,430 of Schonbek (the disclosure of which is incorporated by reference herein), or as displayed in copending U.S. design patent applications 29/252,130 filed on Jan. 19, 2006; 29/252,116 filed on Jan. 19, 2006; or 29/252,131 filed on Jan. 19, 2006 (the disclosures of which are incorporated by reference herein). One method of mounting ornaments 12 and 13 to mounting ribs 24 and 26 is illustrated in FIG. 8 below; other mounting methods may also be used.

Ornament mounting ribs 26 and 28 may vary in thickness from about 0.03125 inches to about 0.5 inches depending upon the size of fixture 10 and the weight of ornaments 12 and 13; however, ribs 26 and 28 are typically between about 0.0625 and about 0.125 inches, such as, 0.0625 inches in thickness. Ornament mounting ribs 26 and 28 may be fabricated from one or more of the materials from which support plates 22 and 24 may be fabricated, for example, polished 304 stainless steel. Ornament mounting ribs 26 and 28 may also be laser cut to provide the intricate geometry shown, though other conventional manufacturing methods may be used.

Though the ornament arrangements illustrated in FIGS. 1 through 3, exclusively illustrate arrangements of octagonal crystals, it is to be understood that aspects of the invention are not limited to octagonal crystals. Specifically, aspects of the invention may include any type of ornaments that can be mounted to mounting ribs 26 and 28. For example, ornaments 12 and 13 may be square crystals, diamond-shaped crystals, kite-shaped crystals, baguettes, pendeloques, icicle-shaped crystals, pear-shaped crystals, or any of the crystal shapes illustrated on the web page http://www.schonbek.com/crystal/pages/cshapes.html (the disclosure of which is included by reference herein) provided by Schonbek Worldwide Lighting Inc. Though aspects of the invention are preferably composed of transparent, translucent, or opaque glass, it is conceived that aspects of the invention may employ ornaments made from transparent, translucent, or opaque plastic, stone, or precious gems, for example, natural or synthetic gems, such as, diamonds, rubies or sapphires. The ornaments may comprise ornaments, for example, glass crystals, provided by the D. Swarovski Company of Wattens, Austria.

As shown in FIG. 3, in one aspect, ornament mounting rib 26 may be provided with one size or shaped ornament 12, and ornament mounting rib 28 may be provided with the same or another size or shaped ornament 13. For example, as shown in FIG. 3, ornaments 12 may be larger than ornaments 13. In one aspect, a plurality of ornament mounting ribs 26 having ornaments 12 may be provided or a plurality of ornament mounting ribs 28 having ornaments 13 may be provided, or a combination thereof. In the aspect shown in FIGS. 1-3, a plurality of ornament mounting ribs 26 having ornaments 12 are alternately mounted with a plurality of ornament mounting ribs 28 having ornaments 13. In another aspect, a plurality of ornament mounting ribs 26 or 28 each having two or more different ornaments 12 and 13 may be provided. Other combinations and permutations of ornament mounting ribs 26 and 28 and ornaments 12 and 13 will be apparent to those of skill in the art and are included within the purview of aspects of the present invention.

Figure 4A:
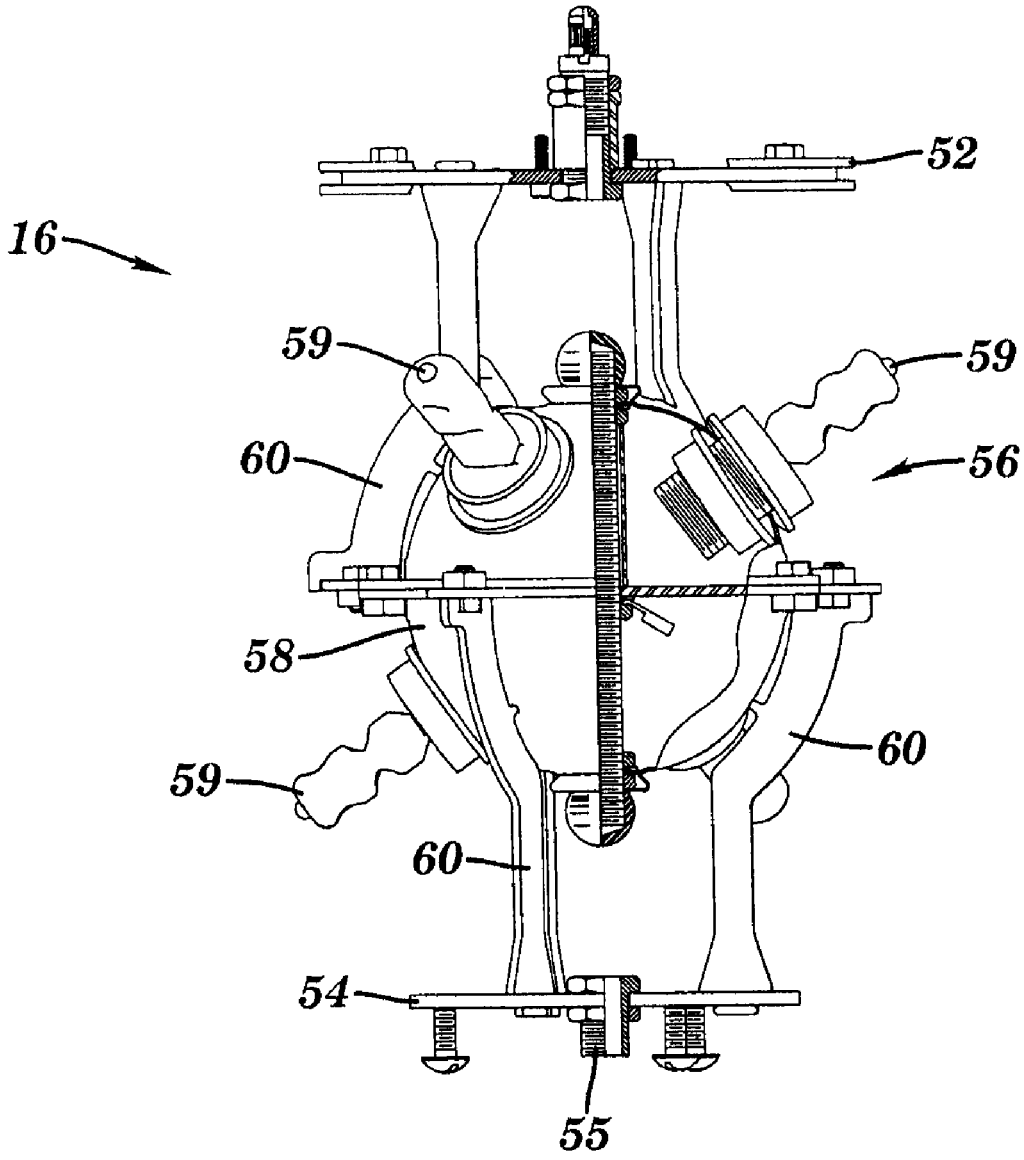
FIGS. 4A and 4B are front elevation views, partially in cross section, of the support frames shown in FIG. 2.
Figure 4B:
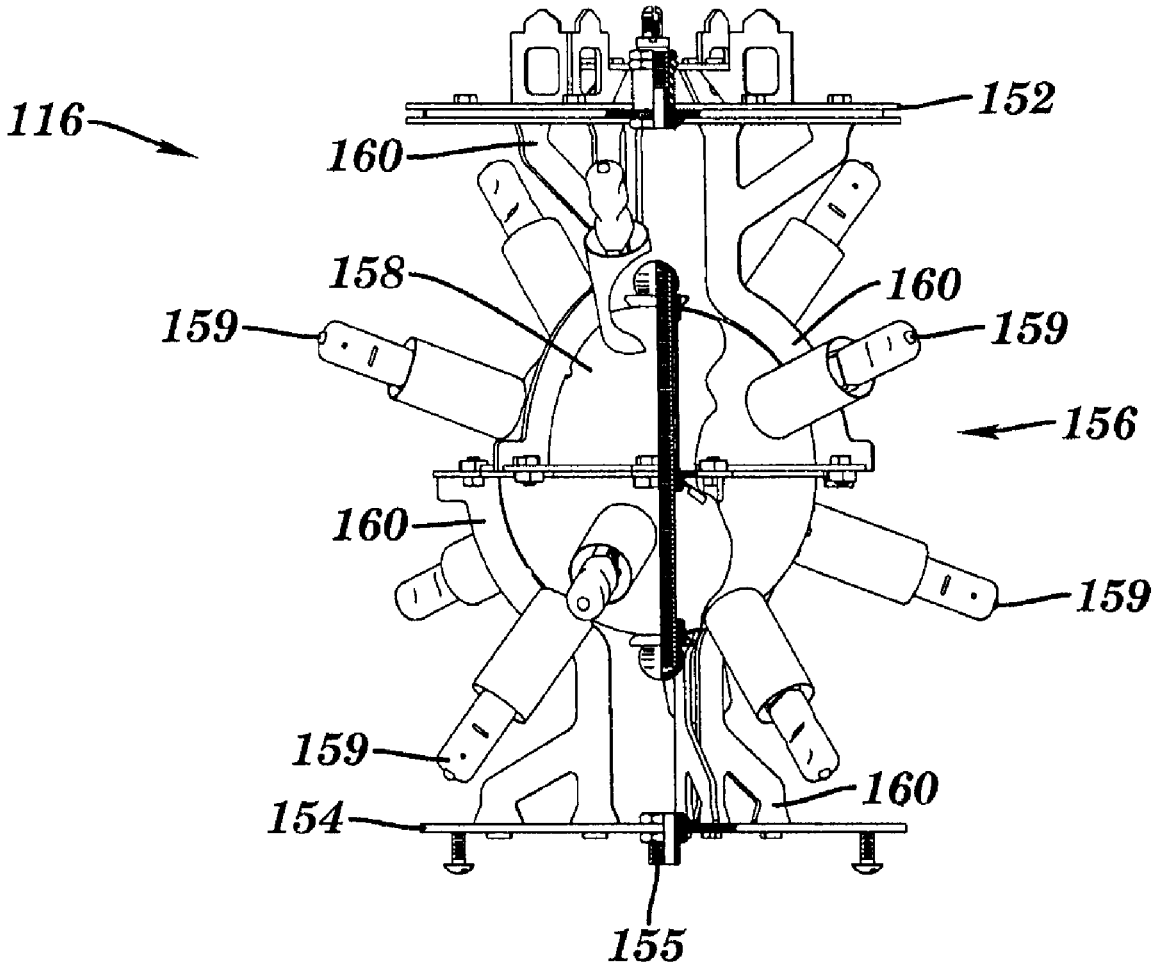

FIGS. 4A and 4B are front elevation views, partially in cross section, of support frames assemblies 16 and 116 that can be used in the fixture 10 shown in FIGS. 1 and 2. As shown in FIG. 2, sector assemblies 14, crown sector assemblies 18, and finial sector assembly 20 are mounted to central support frame assembly 16. As shown in FIG. 4A, support frame assembly 16 includes an upper support ring 52 and at least one lower support ring 54 that is vertically spaced from the upper support ring 52. Support frame assembly 16 may include additional support rings (not shown), for example, support rings similar to support ring 52 (for example, having mounting holes to accommodate pin 19) or 54 (for example, having pins or screws 80 or 180), for instance, to support sector assemblies 14 on larger fixtures 10. Additional support rings 52 or 54 may be adapted to support sector assemblies 14 comprising a plurality of sector assemblies spanning the approximately 180 degree or less latitudinal arc length of sector assemblies 14. Arcuate sector assemblies 14 shown in FIG. 3 are adapted to mount to upper support ring 52 and lower support ring 54, for example, wherein the plurality sector assemblies 14 when mounted to support frame assembly 16 provide a substantially continuous 360 degree longitudinal array of ornaments. As discussed above, in one aspect of the invention, sector assemblies 14 are removably mounted to upper support ring 52 and at least one lower support ring 54.

As shown in FIG. 4A, upper support ring 52 and lower support ring 54 may be mounted on light mounting 56 having a light housing 58, with a plurality of lights 59, and a plurality of mounting posts 60. In one aspect, light housing 58 and lights 59 may be omitted and upper support ring 52 and lower support ring 54 may be separated by a plurality, for example, at least three, mounting posts 60. However, in one aspect, central support frame assembly 16 may include a light fixture, for example, light housing 58, for instance, a spherical light housing 58 as shown, and one or more lights 59. It will be understood that light housing 58 and lights 59 may comprise a broad range of lighting fixtures which are typically adapted to be powered by a power cord (not shown), for example, a power cord wrapped around or in support cable 11. Lower support ring 54 may include one or more threaded fasteners 55, for example, an externally threaded stud, adapted to mount finial assembly 20 (See FIG. 7).

As shown in FIG. 4B, similar to support frame assembly 16 shown in FIG. 4A, support frame assembly 116 includes an upper support ring 152 and at least one lower support ring 154 that is vertically spaced from the upper support ring 152. Support frame assembly 116 may include additional support rings (not shown), for example, support rings similar to support ring 152 or 154, for instance, to support sector assemblies 14 on larger fixtures 10. Additional support rings 152 or 154 may be adapted to support sector assemblies 14 comprising a plurality of sector assemblies spanning the approximately 180 degree or less latitudinal arc length of sector assemblies 14. Arcuate sector assemblies 14 shown in FIG. 3 are adapted to mount to upper support ring 152 and lower support ring 154, for example, wherein the plurality sector assemblies 14 when mounted to support frame assembly 116 provide a substantially continuous 360 degree longitudinal array of ornaments. As discussed above, in one aspect of the invention, sector assemblies 14 are removably mounted to upper support ring 152 and at least one lower support ring 154. As shown in FIG. 4B, upper support ring 152 and lower support ring 154 may be mounted on light mounting 156 having a light housing 158, with a plurality of lights 159, and a plurality of mounting posts 160. As discussed above with respect to support frame assembly 16, light housing 158 and lights 159 may comprise a broad range of lighting fixtures. Lower support ring 154 may include one or more threaded fasteners 155, for example, an externally threaded stud, adapted to mount finial assembly 20 (See FIG. 7).

Figure 5A:
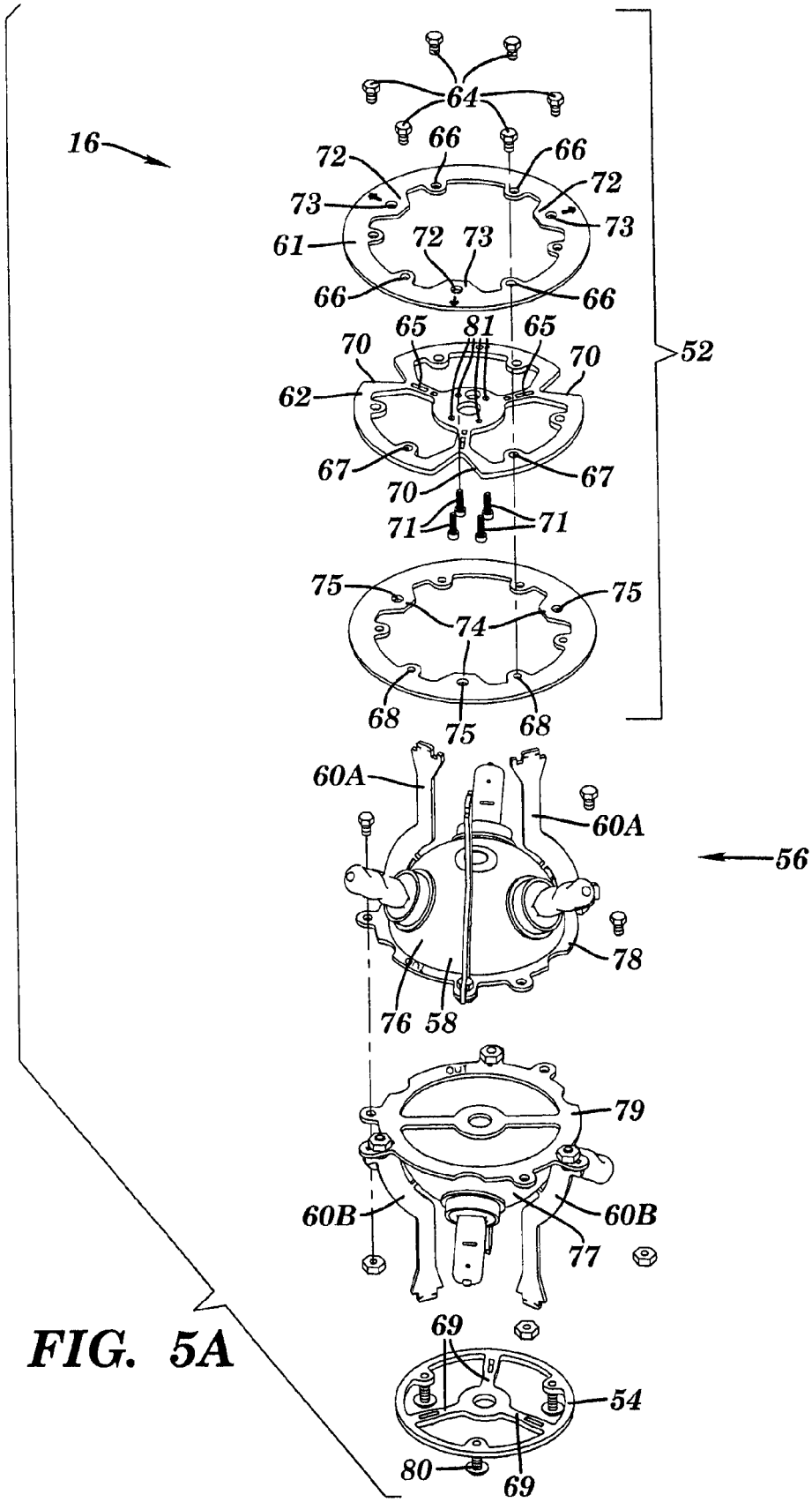
FIGS. 5A and 5B are exploded perspective views of the support frames shown in FIGS. 4A and 4B, respectively.
Figure 5B:
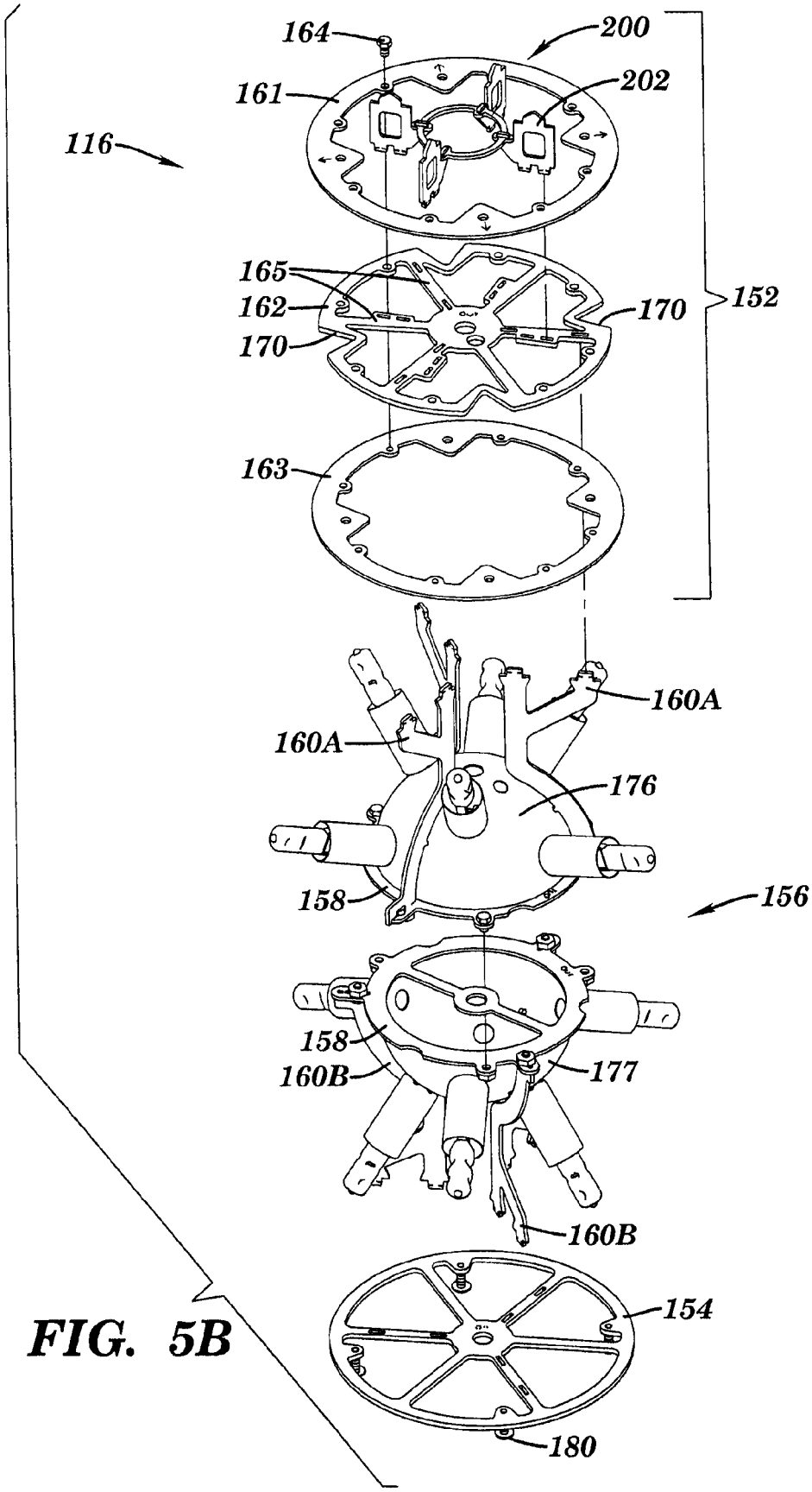

FIGS. 5A and 5B are exploded perspective views of support frame 16 and 116 shown in FIGS. 4A and 4B, respectively. In one aspect, shown in FIG. 5A, upper support ring 52 may comprise a plurality of rings 61, 62, and 63, for example, whereby rings 61 and 63 sandwich ring 62 to provide ring 52. Rings 61, 62, and 63 may be held together by a plurality of threaded fasteners 64 which insert into holes 66 in ring 61, holes 67 in ring 62, and thread into holes 68 in ring 63. Fasteners 64 may be retained by an anti-loosening compound, such as Loctite, by anti-rotation lugs, or by lock wire, among other means of minimizing or prevent fasteners 64 from loosening. According to aspects of the invention, ring 62 includes a plurality of recesses 70 that align with a plurality of projections 72 and 74 in rings 61 and 63, respectively, having though holes 73 and 75, respectively. When rings 61, 62, and 63 are assembled, recesses 70 in ring 62 provide a plurality of blind recesses (see FIG. 2) adapted to receive complementary projections 36 in upper support plate 22 of sector assembly 14 (see FIG. 3). According to aspects of the invention, when projections 36 of support plates 22 are inserted in recesses 70, holes 72 in ring 61 and holes 75 in ring 63 can be aligned with hole 38 in projection 36 of upper support plate 22 whereby pin 19 (See FIG. 2) can be inserted into holes 72, 38, and 75 to retain projection 36 and thus also retain upper support plate 22 and sector assembly 14 on upper support ring 52. Though FIG. 5 illustrates 3 recesses 70 in ring 62, ring 62 may include 2 or more recesses 70 (and 2 or more projections 72 in ring 61 and projections 74 in ring 63), for example, depending upon the number of sector assemblies 14 and the number of projections 36 on sector assemblies 14. Ring 62 may also include a plurality of radial arms 65 adapted to engage mounting posts 60. Ring 62 may also include a plurality of pins or screws 71 inserted into holes 81 that are adapted to engage crown assembly 18 (See FIG. 2). As shown in FIG. 4A, plate 62 may be smaller in outside diameter than rings 61 and 63. As a result, in one aspect, upper support plate 22 may also be supported by rings 61 and 63 when projection 36 in upper support plate 22 is retained by pin 19.

As shown in FIG. 5A, mounting posts 60 may be integrated with light mounting 56 having light housing 58 and lights 59. Though many different types of light mountings 56 may be incorporated into aspects of the invention, as shown in FIG. 5A, in this aspect, light mounting 56 includes a light housing 58 which comprises a spherical housing having hemispheres 76 and 77 and a set of mating light fixture plates 78 and 79. A set of upper mounting posts 60A and a set of lower mounting posts 60B may be mounted to light housing 58 by conventional means, for example, by threaded fasteners.

Lower support ring 54 may be mounted to lower support posts 60B as shown. For example, lower support ring 54 may typically include a plurality of radial arms 69 adapted to engage mounting posts 60B. In one aspect, lower support ring 54 may comprise substantially the same construction as upper support ring 52, that is, a three-ring sandwiched construction having through holes to accommodate pins 19. However, as shown in FIG. 5A, in one aspect, lower support ring 54 may include a plurality of pins or screws 80 adapted to receive through holes 39 in lower support plate 24 (see FIG. 3) of sector assembly 14 to retain sector assembly 14 on central support frame 16.

FIG. 5B illustrates an exploded perspective view of a central support frame 116 according to another aspect of the invention, for example, for a fixture having a diameter greater than the diameter of the fixture mounted on support frame 16 shown in FIG. 5A. Similar to support frame 16 shown in FIG. 5A, support frame 116 shown in FIG. 5B includes an upper support ring 152 comprised of rings 161, 162, and 163 held together by a plurality of threaded fasteners 164. Similar to upper support ring 52, upper support ring 152 is adapted to engage upper support plate 22 of sector assembly 14, for example, by means of pins 19. However, contrary to support ring 52 shown in FIG. 5A, ring 162 of support ring 152 includes 4 recesses 170 and 6 radial arms 165 adapted to engage mounting posts 160 and an intermediate support structure 200. As shown in FIG. 4B, ring 162 may be smaller in outside diameter than rings 161 and 163. As a result, in one aspect, upper support plate 22 may also be supported by rings 161 and 163 when projection 36 in upper support plate 22 is retained by pin 19. In contrast to the structure shown in FIG. 5A, upper support ring 152 also includes an intermediate support structure 200 comprising a plurality of support members 202 mounted to ring 162. As shown, support members 202 may also be mounted to a ring 204 to provide additional stiffness to the assembly, if required. Also, similar to support frame assembly 16 shown in FIG. 5A, support frame assembly 116 shown in FIG. 5B, may also include mounting posts 160 integrated with a light mounting 156 having light housing 158 having hemispheres 176 and 177. Mounting posts 160 may comprise a set of upper mounting posts 160A and a set of lower mounting posts 160B and a lower support ring 154 may be mounted to lower support posts 160B as shown. Again, lower support ring 154 may comprise substantially the same construction of upper support ring 152, that is, a three-ring sandwiched construction having through holes to accommodate pins 19, but, as shown in FIG. 5B, lower support ring 154 may include a plurality of pins or screws 180 adapted to receive through holes 39 in lower support plate 24 (see FIG. 3) of sector assembly 14 to retain sector assembly 14 on central support frame 116.

Though as shown in FIGS. 4A, 4B, 5A, and 5B, sector assemblies 14 may be mounted to support frame 16 or 116 by means of pins 19 and 80 or 180, sector assemblies 14 may be mounted to support frame 16 or 116 by various conventional means. For example, sector assemblies 14 may be mounted to support frame 16 or 116 by conventional fasteners, for example, threaded fasteners, spring-loaded fasteners, for instance, a plurality of spring-ball plungers, and the like, or magnets. Other conventional means for mounting sector assemblies 14 to support frame 16 or 116 will be apparent to those of skill in the art.

Figure 6:
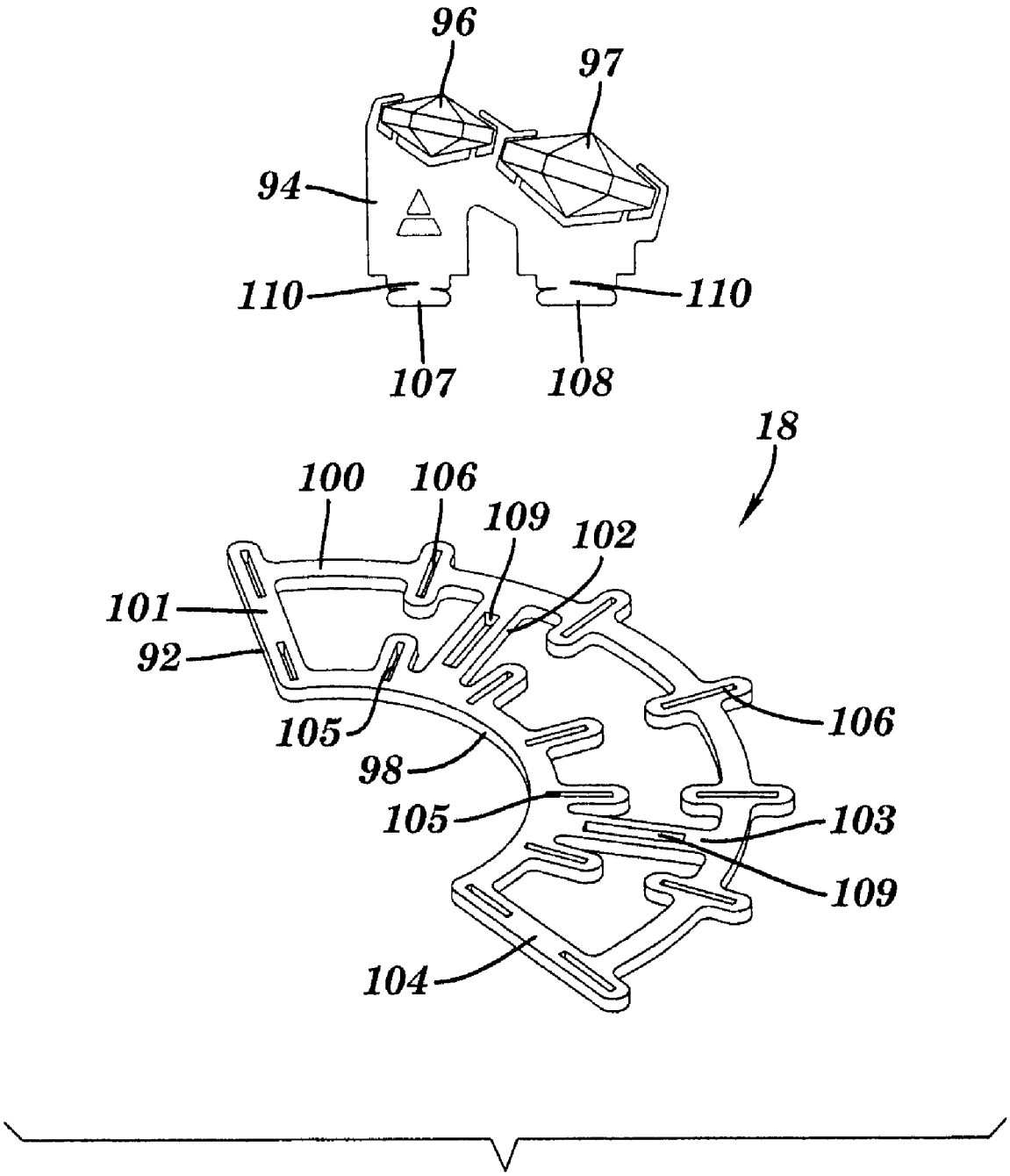
FIG. 6 is an exploded perspective view of a crown sector assembly shown in FIG. 2.

FIG. 6 is an exploded perspective view of one crown sector assembly 18 shown in FIG. 2. At least one, but typically a plurality of crown sector assemblies 18 may be provided, for example, depending upon the size of fixture 10. As shown, crown sector assembly 18 includes a crown sector plate 92 and a plurality of crown sector mounting posts 94 adapted to retain ornaments 96 and 97, for example, one or more ornaments 12 and/or 13 discussed above. Though crown sector assembly 18 typically includes a plurality of mounting posts 94, only a single mounting post 94 is shown in FIG. 6 to facilitate illustration. Ornaments 96 and 97 may be mounted to mounting posts 94 as discussed below with respect to FIG. 8, among other methods. Depending on the number of crown sector assemblies 18, the arc length of crown sector plate 92 may vary from, for example, 360 degrees of arc when one crown sector assembly 18 is provided; to 180 degrees, when two are provided; to 90 degrees, when four are provided. Shorter arc lengths may also be provided if more assemblies 18 are provided. Sector plate 92 may be provided as a sold plate with perforations, but is typically provided as a perforated plate having circumferential arcs 98 and 100 and radial arms 101, 102, 103, and 104 to minimize weight and material usage. Sector plate 92 includes a plurality of slots 105 and 106 adapted to receive projections 107 and 108 in mounting posts 94 and a plurality of slots 109 adapted to receive projections in mounting posts 202 in intermediate support 200 in central support frame 116 shown in FIG. 5B. Though not shown in FIG. 6, sector plate 92 may also include one or more through holes (not shown) adapted to receive pins or screws 71 in upper support plate 52 of central support frame 16 shown in FIG. 5A. Mounting posts 92 may comprise any rod, bar, post, or plate adapted to retain one or more ornaments 96 and 97 and mount to plate 92. As shown in FIG. 6, mounting posts 92 may comprise thin plates, for example, thin metal or non-metal plates, fashioned to receive ornaments 96 and fashioned to engage plate 92. For example, mounting posts 92 may include one or more tabs or projections 107 and 108 adapted to engage slots 105 and 106 in plate 92. As is typical in aspects of the invention, tabs 107 and 108 may include one or more slits 110 that allow the ends of tabs 107 and 108 to be deformed after tabs 107 and 108 are inserted into slots 105 and 106, respectively, to prevent tabs 107 and 108 from disengaging from slots 105 and 106. The height of posts 92 may vary depending, among other things, upon the size of fixture 10.

Figure 7:
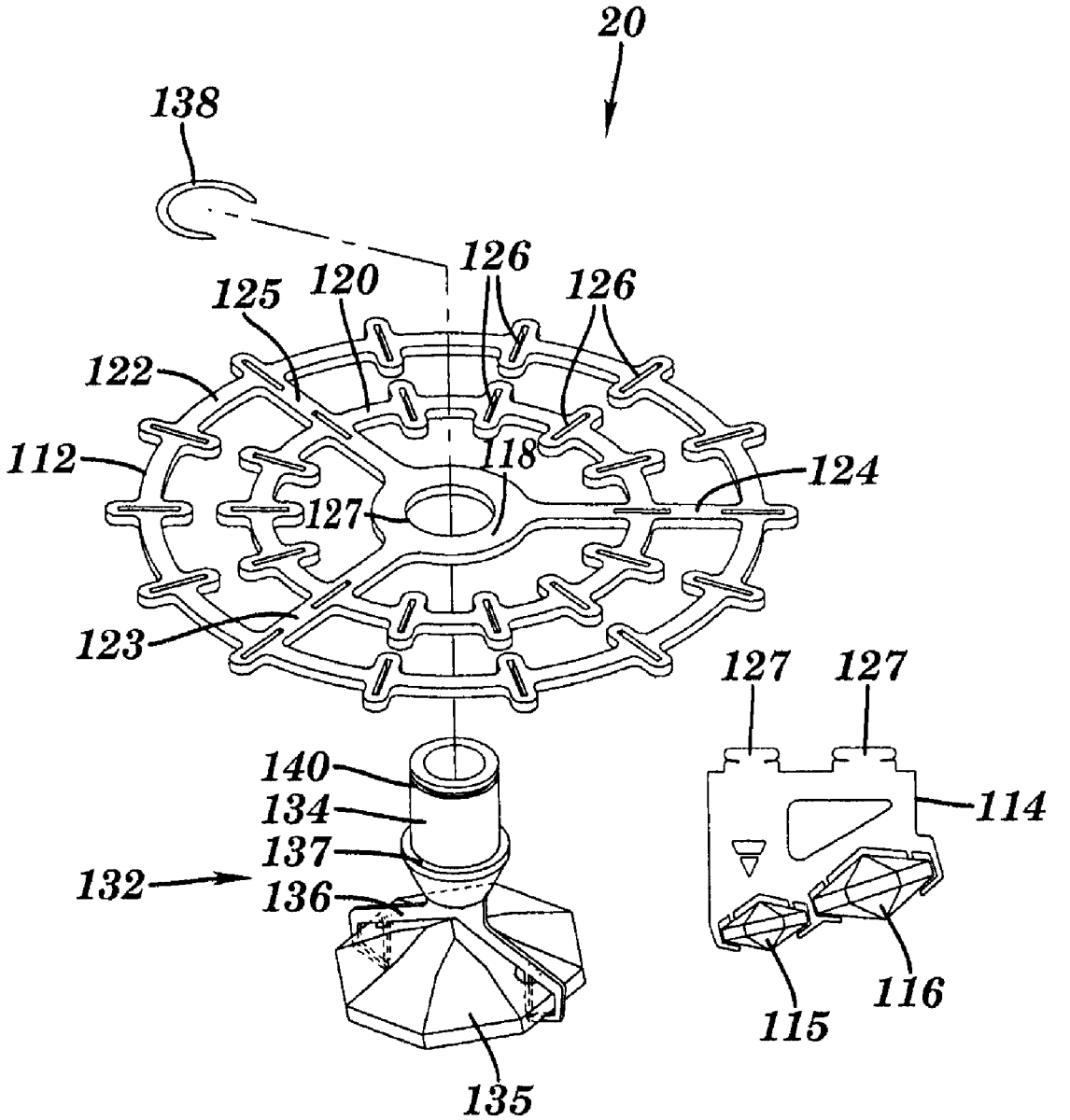
FIG. 7 is an exploded perspective view of a finial sector assembly shown in FIG. 2.

FIG. 7 is an exploded perspective view of finial sector assembly 20 shown in FIG. 2. Though in one aspect, a plurality of finial sector assemblies 20 may be provided, that is, in a fashion similar to crown sector assembly 18 shown in FIG. 6, in the aspect shown in FIG. 7, only a single finial sector assembly 20 is provided. As shown, finial sector assembly 20 includes a finial plate 112 and a plurality of final sector mounting posts 114 adapted to retain ornaments 115 and 116, for example, one or more ornaments 12 and/or 13 discussed above. Though finial sector assembly 20 typically includes a plurality of mounting posts 114, only a single mounting post 114 is shown in FIG. 7 to facilitate illustration. Ornaments 115 and 116 may be mounted to mounting posts 114 as illustrated in FIG. 8, discussed below. Depending upon the number of finial sector assemblies 20, the arc length of finial sector plate 112 may vary from, for example, 360 degrees of arc when one finial sector assembly 20 is provided (as shown in FIG. 6); to 180 degrees, when two are provided; to 90 degrees, when four are provided. Shorter arc lengths may also be provided if more assemblies 20 are provided. Finial plate 112 may be provided as a sold plate with perforations, but is typically provided as a perforated plate having circumferential arcs or rings 118, 120, and 122, and radial arms 123, 124, and 125 to minimize weight and material usage. Finial plate 112 may typically include a central hole 127 for mounting finial sector assembly 20, as will be discussed below. Sector plate 112 includes a plurality of slots 126 adapted to receive projections 127 in mounting posts 114. Mounting posts 114 may comprise any rod, bar, post, or plate adapted to retain one or more ornaments 115 and 116 and mount to plate 112. As shown in FIG. 7, mounting posts 114 may comprise thin plates, for example, thin metal or non-metal plates, fashioned to receive ornaments 115 and 1116 and fashioned to engage plate 112. Mounting posts 112 may include one or more tabs or projections 127 adapted to engage slots 126 in plate 112, for example, in a fashion discussed above with respect to FIG. 6. The height of mounting posts 114 may vary depending, among other things, upon the size of fixture 10.

As also shown in FIG. 7, finial sector assembly 20 may also include one or more retaining nut assemblies 132. Retaining nut assembly 132 is adapted to mount finial sector assembly 20 to central support frame 16 or 116 to substantially complete the spherical structure of fixture 10. Retaining nut assembly 132 may be adapted to mount to lower support plate 124. Retaining nut assembly 132 may include a cylinder 134 and an ornament mounting post 136 mounted to cylinder 134, for example, welded to cylinder 134. Ornament mounting post 136 is adapted to retain one or more ornaments 135, for example, one or more ornaments 12 and/or 13 discussed above. Though ornament mounting post 136 may comprise a plurality of mounting posts, only a single mounting post 136 is shown in FIG. 7. Ornaments 135 may be mounted to mounting post 136 as shown in FIG. 8 and discussed below, though other methods may be used.

Cylinder 134 may be an internally or externally threaded and is typically sized to pass through central hole 127 in finial plate 112. Cylinder 134 may also include a lip or shoulder 137 sized to engage central hole 127 when finial sector assembly 20 is mounted to support frame 16 or 116. Though in one aspect of the invention cylinder 134 may be rigidly mounted to plate 112 of finial sector assembly 20, in one aspect, cylinder 134 preferably slidably engages hole 127 in plate 112. When slidably engaged, retaining nut assembly 132 may also include a collar or ring 138 adapted to engage a groove or slot 140 in cylinder 134. Ring 138 may be a retaining ring or snap ring adapted to engage and disengage cylinder 134; however, ring 138 may also be welded in slot 140, for example, laser welded, to rigidly mount ring 138 to cylinder 134. As a result, in one aspect of the invention, cylinder 134 may be free to translate within hole 127 while being retained by ring 138 and shoulder 137. Shoulder 137 may also comprise a ring inserted in an appropriate slot in cylinder 134. According to an aspect of the invention, cylinder 134 may be threaded on to complementary threaded shaft or hole in central support frame 16 or 116, for example, to bottom plate 54 or 154 (See FIGS. 5A and 5B). For example, cylinder 134 may be mounted to stud 55 or 155 in bottom plate 54 or 154, respectively, shown in FIGS. 4A and 4B.

FIG. 8 is a perspective view illustrating a step-wise method 210 of mounting ornaments 214 to a structure 212A according to one aspect of the invention. Ornaments 214 may be any ornaments disclosed herein, for example, ornaments 12 and 13. Structure 212A may comprise any structure disclosed herein to which an ornament is mounted. For example, structure 212A may be ornament mounting rib 26 or 28 in FIG. 3, crown sector mounting post 94 in FIG. 6, or finial sector mounting post 114 or ornament mounting frame 136 in FIG. 7. The design of structure 212A may be similar to that shown in pending U.S. design patent application 29/252,130, the disclosure of which has been incorporated by reference herein. In FIG. 8, the manipulation of structure 212A in mounting method 210 is represented by the successive structures 212B through 212E; the structure of structures 212A through 212E are essentially the same.

As shown in FIG. 8, structure 212A includes flat plate or sheet 213, for example, plastic or metal sheet, having a recess 220 adapted to receive ornament 214, a plurality of pins 224 projecting from plate 213 about recess 220, and a plurality of mounting posts 226 projecting from plate 213. Mounting posts 226 include pliable projections 228 and 229 projecting from mounting posts 226, for example, projecting at an angle less than 90 degrees from the axis of posts 226.

According to aspects of the invention, as shown at structure 212B, mounting posts 226 are deformable whereby they can be twisted at least 15 degrees, typically, about 90 degrees as shown by circular arrow 230. Though arrow 230 is illustrated directed in the counter-clockwise direction looking down on structure 212B, mounting posts 226 may be twisted in a counter-clockwise or clockwise direction to deflect projections 228 and 229 to expose the ends of pins 224. Mounting posts 226 may be twisted manually, for example, with a hand tool, or automatedly, for example, by means of a robotic manipulator. Once pins 224 are exposed, as shown in structure 212C, ornament 214 may be mounted on pins 224 by placing ornament 214 wherein pins 224 penetrate holes or perforations 216 and 218 in ornament 214. After ornament 214 is located on pins 224, as shown in structure 212D, mounting posts 226 may be twisted in the opposite direction shown in structure 212B, for example, in a clockwise direction as indicted by arrow 232, to deflect projections 228 and 229 to their substantially original position shown in structure 212A to captivate ornament 214 on pins 224. As shown in structure 212E, according to one aspect of the invention, ornament 214 is captivated on plate 213 by pins 214 and projections 228 and 229 on posts 226.

According to aspects of the present invention, in addition to providing new and non-obvious ornamental fixture compare to the prior art, unlike existing art, ornamental fixture 10 may be easily cleaned. Specifically, fixture 10 may be disassembled, for example, as shown in the exploded view of FIG. 2, and then the individual ornament containing components, that is, sector assemblies 14, crown sector assemblies 18, and finial sector assembly 20 may be easily handled and their structures and ornaments cleaned. In one aspect, the sector assemblies 14 may be removed from support frame 16 or 116 and cleaned without damaging the fixture 10 or the ornaments 12 and 13. Most surprisingly, in one aspect, sector assembly 14, crown sector assemblies 18, and/or finial sector assembly 20, all having ornaments 12 and 13, may be placed into an automated washing device, for example, a residential or commercial dishwasher, and the washing device activated to clean the sector assembly 20, without damaging ornaments 12 and 13 or the structures of sector assembly 14, crown sector assemblies 18, and/or finial sector assembly 20. According to one aspect of the invention, the ornament mounting illustrated in FIG. 8 is used to retain ornaments 12 and 13 on, for example, sector assembly 14, whereby contact between ornaments 12 and 13, which can cause damage to ornaments 12 and 13, is prevented. In addition, the support structures of sector assemblies 14, crown sector assemblies 18, and the finial sector assembly 20 are typically made from a corrosion resistant (that is, dishwasher resistant) material, for example, polished 304 stainless steel. After washing, the assemblies can be remounted to central support frame 16 or 116 and ornamental fixture 10 suspended as desired.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. An ornamental fixture comprising:

a support frame assembly having an upper support ring and at least one lower support ring vertically spaced from the upper support ring;

a plurality of arcuate sector assemblies mounted to the upper support ring and the at least one lower support ring, each sector assembly having a plurality of ornaments attached thereto and wherein the plurality of arcuate sector assemblies span a longitudinal arc and a latitudinal arc; and wherein a substantially continuous 360-degree array of ornaments is provided.

2. The fixture as recited in claim 1, wherein the plurality of sector assemblies is removably mounted to the upper support ring and the at least one lower support ring.

3. The fixture as recited in claim 1, wherein the fixture comprises a substantially spherical ornamental fixture.

4. The fixture as recited in claim 1, wherein each of the plurality of sector assemblies comprises an upper support plate and a lower support plate, wherein the upper support plate is removably mounted to the upper support ring of the support frame assembly and the lower support plate is removably mounted to the lower support ring of the support frame assembly.

5. The fixture as recited in claim 4, wherein each of the plurality of sector assemblies further comprises a plurality of ornament mounting ribs having the plurality of ornaments, wherein the plurality of ornament mounting ribs are mounted to the upper support plate and to the lower support plate of the sector assemblies.

6. The fixture as recited in claim 4, wherein at least one of the upper support ring and the lower support ring of the support frame assembly comprises a first perforation and wherein at least one of the upper support plate and the lower support plate of the sector assemblies comprise a second perforation, wherein the fixture further comprises at least one pin removably inserted into the first perforation and the second perforation to removably mount the sector assemblies to the support frame assembly.

7. The fixture as recited in claim 6, wherein at least one of the upper support plate and the lower support plate of the sector assemblies comprises a projection, wherein the first perforation is positioned in the projection.

8. The fixture as recited in claim 1, wherein the fixture further comprises a light.

9. The fixture as recited in claim 1, wherein the plurality of sector assemblies comprises at least 3 sector assemblies.

10. The fixture as recited in claim 1, wherein the plurality of ornaments comprises a plurality of octagonal glass crystals.

11. A method for assembling an ornamental fixture comprising:

providing a support frame assembly having an upper support ring and at least one lower support ring vertically spaced from the upper supper ring; and mounting a plurality of arcuate sector assemblies, each of the sector assemblies having a plurality of ornaments attached thereto and each of the plurality of arcuate sector assemblies spanning a longitudinal arc and a latitudinal arc, to the upper support ring and to the at least one lower support ring to provide a substantially continuous 360-degree array of ornaments.

12. The method as recited in claim 11, wherein each of the plurality of sector assemblies comprises an upper support plate and a lower support plate, wherein mounting the plurality of arcuate sector assemblies comprises mounting one upper support plate of at least one sector assembly to the upper support ring of the support frame assembly and mounting the lower support plate of at least one sector assembly to the lower support ring of the support frame assembly.

13. The method as recited in claim 12, wherein the upper support ring of the support frame assembly comprises a first perforation and wherein the upper support plate of the at least one sector assembly comprises a second perforation, wherein mounting the upper support plate to the upper support ring comprises:

aligning the first perforation with the second perforation; and inserting a pin into the first perforation and the second perforation to secure the upper support plate of the at least one sector assembly to the upper support ring of the support frame assembly.

14. The method as recited in claim 12, wherein the upper support ring of the support frame assembly comprises at least one recess having a first perforation and wherein the upper support plate of the at least one sector assembly comprises a projection having a second perforation, wherein mounting the upper support plate to the upper support ring comprises:

inserting the projection of the upper support plate into the at least one recess of the upper support ring;

aligning the first perforation with the second perforation; and inserting a pin into the first perforation and the second perforation to secure the upper support plate of the at least one sector assembly to the upper support ring of the support frame assembly.

15. The method as recited in claim 11, wherein the support frame assembly further comprises a top and a bottom, wherein the method further comprises:

mounting at least one first substructure having a plurality of ornaments to the top of the support frame assembly; and mounting at least one second substructure having a plurality of ornaments to the bottom of the support frame assembly;

wherein the arcuate sector assemblies, the first substructure, and the second substructure, when mounted to the support frame assembly provide a substantially complete spherical array of ornaments.

16. A method of servicing an ornamental fixture comprising:

the method recited in claim 11, further comprising:

removing at least one of the plurality of arcuate sector assemblies from the support frame assembly; and servicing at least one of the plurality of arcuate sector assemblies without damaging the fixture and the ornaments.

17. The method as recited in claim 16, wherein servicing comprises cleaning at least one of the plurality of sector assemblies by placing at least one of the plurality of arcuate sector assemblies into an automated washing device and activating the automated washing device.

18. The method as recited in claim 17, wherein the automated washing device comprises a dishwasher.

19. The method as recited in claim 16, wherein removing at least one of the plurality of arcuate sector assemblies from the support frame assembly comprises removing all of the plurality of arcuate sector assemblies; and wherein servicing at least one of the plurality of arcuate sector assemblies comprises cleaning all of the plurality of arcuate sector assemblies.

20. The method as recited in claim 16, wherein the method further comprises mounting the at least one serviced arcuate sector assembly to the support frame assembly.

21. An ornamental fixture comprising:

a plurality of ornaments positioned on a surface of a sphere, the plurality of ornaments positioned on the surface of the sphere by a plurality of sector assemblies, and the plurality of sector assemblies span a longitudinal arc and a latitudinal arc; and a light source mounted within the plurality of ornaments.

22. The ornamental fixture as recited in claim 21, wherein the plurality of ornaments comprises at least a section having ornaments arranged in a substantially complete 360-degree array about an equator of the sphere.

23. The ornamental fixture as recited in claim 22, wherein the plurality of ornaments are positioned on substantially the entire surface of the sphere.

24. The ornamental fixture as recited in claim 21, wherein the plurality of ornaments comprise octagonal glass crystals.

25. The ornamental fixture as recited in claim 21, wherein the plurality of sector assemblies span about 90 degrees of latitudinal arc.

26. The ornamental fixture as recited in claim 25, wherein the plurality of sector assemblies span about 180 degrees of latitudinal arc.

27. The ornamental fixture as recited in claim 21, wherein the light source is mounted inside the plurality of ornaments.

28. The ornamental fixture as recited in claim 21, wherein the light source is mounted inside the surface of the sphere.

* * * * *